US009016034B2

(12) United States Patent
Hall

(10) Patent No.: US 9,016,034 B2
(45) Date of Patent: Apr. 28, 2015

(54) EASILY OPENABLE CAN END, CONTAINER, AND METHODS OF FORMING

(75) Inventor: Jason John Hall, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 647 days.

(21) Appl. No.: 13/062,321

(22) PCT Filed: Aug. 6, 2009

(86) PCT No.: PCT/EP2009/060243
§ 371 (c)(1),
(2), (4) Date: Mar. 4, 2011

(87) PCT Pub. No.: WO2010/026019
PCT Pub. Date: Mar. 11, 2010

(65) Prior Publication Data

US 2011/0308202 A1 Dec. 22, 2011

(30) Foreign Application Priority Data

Sep. 4, 2008 (EP) ..... 08163704

(51) Int. Cl.
*B65D 17/34* (2006.01)
*B65B 7/28* (2006.01)
(Continued)

(52) U.S. Cl.
CPC ..... *B65D 17/163* (2013.01); *B65B 61/24* (2013.01); *B65B 63/08* (2013.01); *B65B 7/2857* (2013.01); *B65D 2517/0073* (2013.01); *B65D 2517/0089* (2013.01)

(58) Field of Classification Search
CPC .... B65B 61/24; B65B 63/08; B65B 2220/24; B65B 7/285; B65B 7/2857; B65D 17/163; B65D 17/165; B65D 2517/0073; B65D 2517/0079
USPC ..... 53/420, 432, 440, 471, 485, 486; 220/269, 270, 272, 273, 623, 624; 413/2
IPC ..... B65B 63/08,61/24; B65D 17/34
See application file for complete search history.

(56) References Cited

U.S. PATENT DOCUMENTS 601,787 A 4/1898 Bloch
1,570,732 A 1/1926 Emerson
(Continued)

FOREIGN PATENT DOCUMENTS

DE 2540362 A * 3/1977 ..... B65D 17/24
EP 0088185 9/1983
(Continued)

OTHER PUBLICATIONS

U.S. Appl. No. 12/465,894, filed May 14, 2009, Saucedo.
(Continued)

*Primary Examiner* — Stephen F Gerrity
(74) *Attorney, Agent, or Firm* — Baker & Hostetler LLP

(57) ABSTRACT

An easily openable can end and associated methods include an end panel, a score line formed in the end panel to define a prearranged opening area, a tab, the tab having a handle and a rivet securing the tab to the end panel. In particular, the end panel of the can end is provided with at least one moveable portion contactable with the lower surface of the tab at a location between the rivet and the end of the handle of the tab, the moveable portion being deformable upwardly under influence of pressure to push against the lower surface of the tab and thereby incline the handle of the tab away from the end panel to define a gap under the tab.

19 Claims, 6 Drawing Sheets

(51) Int. Cl.

| | |
|---|---|
| ***B65B 61/24*** | (2006.01) |
| ***B65B 63/08*** | (2006.01) |
| ***B65D 17/00*** | (2006.01) |

(56) References Cited

U.S. PATENT DOCUMENTS

| | | | | | |
|---|---|---|---|---|---|
| 2,054,066 | A | | 9/1936 | Ayers et al. | |
| 2,124,959 | A | * | 7/1938 | Vogel | 53/471 |
| 2,261,117 | A | | 11/1941 | Jack, Jr. | |
| 2,759,307 | A | | 8/1956 | Eolkin | |
| 2,971,671 | A | * | 2/1961 | Shakman | 220/624 |
| 3,152,711 | A | | 10/1964 | Mumford et al. | |
| 3,160,302 | A | | 12/1964 | Chaplin | |
| D200,021 | S | | 1/1965 | Bozek | |
| 3,221,924 | A | | 12/1965 | Harvey et al. | |
| 3,369,689 | A | | 2/1968 | Dodge | |
| 3,400,853 | A | | 9/1968 | Jacobsen | |
| 3,401,821 | A | * | 9/1968 | Bozek | 220/270 |
| 3,404,801 | A | | 10/1968 | Silver | |
| 3,477,608 | A | | 11/1969 | Fraze | |
| D219,370 | S | | 12/1970 | Saunders | |
| 3,559,843 | A | | 2/1971 | Kern | |
| D221,930 | S | | 9/1971 | Saunders | |
| 3,643,833 | A | | 2/1972 | Fraze et al. | |
| 3,650,387 | A | | 3/1972 | Hornsby et al. | |
| 3,662,916 | A | | 5/1972 | Holk | |
| D224,209 | S | | 7/1972 | Kinkel et al. | |
| 3,674,171 | A | | 7/1972 | Fahlbusch | |
| 3,703,979 | A | * | 11/1972 | Douty | 220/270 |
| 3,704,140 | A | | 11/1972 | Petit et al. | |
| D226,071 | S | | 1/1973 | Saunders | |
| D226,073 | S | | 1/1973 | Wesphal | |
| 3,724,709 | A | | 4/1973 | Westphal | |
| 3,744,662 | A | | 7/1973 | Zundel | |
| 3,762,596 | A | | 10/1973 | Henning et al. | |
| 3,779,417 | A | | 12/1973 | Klein | |
| 3,838,788 | A | | 10/1974 | Stargell | |
| 3,839,843 | A | | 10/1974 | Stewart, Jr. | |
| 3,863,801 | A | * | 2/1975 | Pillnik | 220/270 |
| 3,905,513 | A | | 9/1975 | Klein | |
| 3,929,251 | A | | 12/1975 | Urmston | |
| 3,930,592 | A | | 1/1976 | DiIanni | |
| 3,938,696 | A | | 2/1976 | Herbst | |
| 3,941,277 | A | | 3/1976 | McKinney et al. | |
| 3,951,299 | A | | 4/1976 | Khoury | |
| 3,952,911 | A | | 4/1976 | Bozek et al. | |
| 3,967,752 | A | | 7/1976 | Cudzik | |
| 3,986,633 | A | * | 10/1976 | Jordan | 220/273 |
| D243,833 | S | | 3/1977 | Markert | |
| 4,015,744 | A | | 4/1977 | Brown | |
| 4,030,631 | A | | 6/1977 | Brown | |
| 4,150,777 | A | | 4/1979 | Cyr et al. | |
| 4,205,760 | A | | 6/1980 | Hasegawa | |
| 4,252,247 | A | | 2/1981 | Asbury | |
| 4,266,688 | A | | 5/1981 | Reid | |
| D263,803 | S | | 4/1982 | Fraze | |
| 4,333,581 | A | | 6/1982 | Flansburg | |
| 4,361,244 | A | | 11/1982 | Walter | |
| 4,369,888 | A | | 1/1983 | Walter | |
| 4,397,400 | A | | 8/1983 | Walter | |
| 4,442,950 | A | | 4/1984 | Wilson | |
| 4,458,469 | A | | 7/1984 | Dunn | |
| 4,463,866 | A | | 8/1984 | Mandel | |
| 4,503,989 | A | | 3/1985 | Brown et al. | |
| D278,980 | S | | 5/1985 | Brown et al. | |
| 4,524,879 | A | | 6/1985 | Fundom et al. | |
| 4,557,398 | A | | 12/1985 | Hambleton et al. | |
| 4,559,729 | A | | 12/1985 | White | |
| 4,571,978 | A | | 2/1986 | Taube et al. | |
| 4,674,649 | A | * | 6/1987 | Pavely | 220/271 |
| 4,680,917 | A | | 7/1987 | Hambleton et al. | |
| 4,701,090 | A | | 10/1987 | Smith | |
| 4,716,755 | A | | 1/1988 | Bulso et al. | |
| 4,722,215 | A | | 2/1988 | Taube et al. | |
| 4,747,511 | A | | 5/1988 | Dutt et al. | |
| 4,836,398 | A | * | 6/1989 | Leftault, Jr. et al. | 220/624 |
| D307,720 | S | | 5/1990 | Saunders | |
| D312,404 | S | | 11/1990 | Bray et al. | |
| 5,011,037 | A | | 4/1991 | Moen et al. | |
| D321,326 | S | | 11/1991 | Harwood | |
| 5,064,087 | A | | 11/1991 | Koch | |
| 5,069,356 | A | | 12/1991 | Zysset | |
| 5,169,017 | A | | 12/1992 | Cooper et al. | |
| D332,402 | S | | 1/1993 | Harwood et al. | |
| 5,199,618 | A | | 4/1993 | Reil et al. | |
| 5,307,947 | A | | 5/1994 | Moen et al. | |
| 5,335,808 | A | | 8/1994 | Lee | |
| D352,898 | S | | 11/1994 | Vacher | |
| 5,502,995 | A | | 4/1996 | Stodd | |
| 5,581,978 | A | | 12/1996 | Hekal et al. | |
| 5,593,063 | A | * | 1/1997 | Claydon et al. | 220/608 |
| 5,622,273 | A | | 4/1997 | Kelly | |
| D382,481 | S | | 8/1997 | McEldowney | |
| 5,671,860 | A | | 9/1997 | Louwerse et al. | |
| 5,685,189 | A | | 11/1997 | Nguyen et al. | |
| 5,730,314 | A | * | 3/1998 | Wiemann et al. | 220/609 |
| 5,743,445 | A | | 4/1998 | Benarrouch | |
| 5,749,257 | A | | 5/1998 | McEldowney | |
| 5,804,237 | A | | 9/1998 | Diamond et al. | |
| 5,813,561 | A | | 9/1998 | Chang et al. | |
| 5,947,317 | A | | 9/1999 | Hall | |
| 6,024,239 | A | | 2/2000 | Turner et al. | |
| D421,907 | S | | 3/2000 | Benge et al. | |
| 6,059,137 | A | | 5/2000 | Westwood et al. | |
| 6,089,072 | A | | 7/2000 | Fields | |
| 6,105,806 | A | | 8/2000 | Stasiuk | |
| D432,015 | S | | 10/2000 | Holiday | |
| 6,138,856 | A | | 10/2000 | Ghim et al. | |
| 6,202,881 | B1 | | 3/2001 | Chiang | |
| 6,206,220 | B1 | | 3/2001 | Stodd | |
| 6,290,447 | B1 | | 9/2001 | Siemonsen et al. | |
| 6,427,861 | B1 | | 8/2002 | Cho | |
| 6,702,538 | B1 | | 3/2004 | Heinicke et al. | |
| 6,723,360 | B1 | | 4/2004 | Dunaway | |
| D520,358 | S | | 5/2006 | Heinicke | |
| 7,168,586 | B2 | | 1/2007 | Jeon | |
| 7,174,762 | B2 | | 2/2007 | Turner et al. | |
| 7,305,861 | B2 | | 12/2007 | Turner et al. | |
| 7,341,163 | B2 | | 3/2008 | Stodd | |
| D565,406 | S | | 4/2008 | Foskett | |
| D568,741 | S | | 5/2008 | Foskett | |
| 7,407,061 | B2 | | 8/2008 | Fares et al. | |
| D579,771 | S | | 11/2008 | Cherian | |
| 7,500,376 | B2 | | 3/2009 | Bathurst et al. | |
| 7,617,945 | B2 | | 11/2009 | Cherian | |
| 7,909,196 | B2 | * | 3/2011 | Turner et al. | 220/269 |
| 8,104,319 | B2 | | 1/2012 | Turner et al. | |
| 2002/0113069 | A1 | | 8/2002 | Forrest et al. | |
| 2003/0110736 | A1 | | 6/2003 | Boyd | |
| 2004/0259235 | A1 | | 12/2004 | Fares et al. | |
| 2005/0150889 | A1 | | 7/2005 | Perra | |
| 2005/0210835 | A1 | | 9/2005 | Tamis | |
| 2005/0224497 | A1 | | 10/2005 | Wook | |
| 2005/0263481 | A1 | | 12/2005 | Tanaka et al. | |
| 2006/0060582 | A1 | | 3/2006 | Martinez Gomez | |
| 2007/0068943 | A1 | | 3/2007 | Ramsey | |
| 2007/0108209 | A1 | | 5/2007 | Jeon et al. | |
| 2007/0215620 | A1 | | 9/2007 | Kasper | |
| 2007/0278230 | A1 | | 12/2007 | McEldowney et al. | |
| 2008/0078764 | A1 | | 4/2008 | McEldowney et al. | |
| 2008/0110888 | A1 | | 5/2008 | Turner et al. | |
| 2008/0197132 | A1 | | 8/2008 | Hasegawa et al. | |
| 2008/0314906 | A1 | | 12/2008 | Butcher et al. | |
| 2010/0021270 | A1 | | 1/2010 | McEldowney et al. | |
| 2010/0116374 | A1 | * | 5/2010 | Wilson et al. | 53/486 |
| 2010/0287886 | A1 | * | 11/2010 | Saucedo et al. | 53/452 |

FOREIGN PATENT DOCUMENTS

| | | | | | |
|---|---|---|---|---|---|
| EP | 1577222 | | 9/2005 | | |
| EP | 1958882 | | 8/2008 | | |
| FR | 2826939 | | 1/2003 | | |
| GB | 1316484 | A | * | 5/1973 | B65D 17/165 |
| GB | 1533959 | | | 11/1978 | |

(56) References Cited

FOREIGN PATENT DOCUMENTS

| | | | | | |
|---|---|---|---|---|---|
| GB | 23 200 08 | A | | 6/1998 | |
| JP | 01182247 | A | * | 7/1989 | ..... B65D 17/34 |
| JP | 04044950 | A | * | 2/1992 | ..... B65D 17/32 |
| JP | 6-148128 | | | 5/1994 | |
| JP | 2002-160733 | | | 6/2002 | |
| JP | 2003-054549 | | | 2/2003 | |
| JP | 2003-112735 | | | 4/2003 | |
| KR | 2000-17742 | | | 4/2000 | |
| NL | 7416818 | | | 7/1975 | |
| WO | WO 01/28875 | | | 4/2001 | |
| WO | WO 02/08074 | | | 1/2002 | |
| WO | WO 03/104092 | | | 12/2003 | |
| WO | WO 2006/112765 | | | 10/2006 | |
| WO | WO 2007/039367 | | | 4/2007 | |
| WO | WO 2008/098761 | A1 | | 8/2008 | |

OTHER PUBLICATIONS

U.S. Appl. No. 61/113,490, filed Nov. 11, 2008, Hall.
"Advertisement for Boa Housewares', Canpull", The Canmaker, Jun. 2002, vol. 15, 2 pages.
"Advertisement for Buhrke Tech's New End Opens Easier and Costs Less to Make", The Canmaker, Jan. 1998, vol. 11, 4 pages.
"Cannex Asia's Seamlingly Endless Possibilities", The Canmaker, Feb. 2003, vol. 16, 2 pages.
"Contains 100% of Your Daily EOE Requirements", The Canmaker, Jul. 2000, vol. 13, 3 pages.
"Heinz Takes the Easy Way", The Canmaker, Jun. 1999, vol. 12, 5 pages.
"HL Foods Chooses Easy-Open Ends", The Canmaker, Nov. 1999, vol. 12, 4 pages.
"Impress Grabs Heinz Contract", The Canmaker, Jul. 1999, vol. 12, 6 pages.
"Interesting Openings, Part 3", The Canmaker, Sep. 1999, vol. 12, 2 pages.
"Modelling Helps Easy-Open End Choice", The Canmaker, Apr. 2003, vol. 16, 3 pages.
"New Generation of Easy Open Ends", The Canmaker, Oct. 1998, vol. 11, 2 pages.
"Stacking Giant in France", The Canmaker, Mar. 1998, vol. 11, 3 pages.
"Tab Orientation for Better Easy-Open Performance", The Canmaker, May 2001, vol. 14, 2 pages.
"The Ergonomic and Hygienic Can-End", The Easy Can Company, The Canmaker, Apr. 1998, vol. 11, 5 pages.
"Winter Theme for Toyo's TULC Can", The Canmaker, Dec. 2002, vol. 15, 6 pages.
Bailey, "Making it Easier", The Canmaker, Dec. 1998, vol. 11, 4 pages.
Bailey, "Quality, Not Commodity", The Canmaker, Feb. 2000, vol. 13, 5 pages.
Glendenning, "Ends are Just the Beginning", The Canmaker, Jul. 2001, vol. 11, 8 pages.
Higuera, "Into the Spotlight", The Canmaker, Jun. 2003, vol. 16, 2 pages.
Nutting, "Canned Convenience", The Canmaker, Sep. 2000, vol. 13, 4 pages.
Nutting, "Corned Beef Comes of Age", The Canmaker, Aug. 2003, vol. 16, 3 pages.
Nutting, "Legendary Success, UK Awards", The Canmaker, Nov. 2003, vol. 16, 4 pages.
Nutting, "Performance Proposal", The Canmaker, Oct. 2000, vol. 13, 4 pages.
Nutting, "The Sweet Aroma of Success", The Canmaker, Jun. 2001, vol. 14, 5 pages.
Nutting, "Thinner, Lighter, Easier", The Canmaker, Nov. 2000, vol. 13, 5 pages.
Nutting, "Uncrowned Champs", The Canmaker, Aug. 2001, vol. 14, 3 pages.
Nutting, "Uphill Struggle", The Canmaker, Jul. 2003, vol. 16, 3 pages.
Page, "The Rigours of Processing", The Canmaker, Jan. 1999, vol. 12, 3 pages.
Pye, "Visible Benefits . . . Easy Does it", The Canmaker, Jun. 1998, vol. 11, 4 pages.
Searle, "A Century of Ends", The Canmaker, Jul. 2006, vol. 19, 4 pages.
Supplementary European Search report dated Jul. 30, 2007, issued in EP patent application No. 03730882, now EP publication No. 1919786, 2 pages.
"Definition of Offset", Webster's New World Dictionary, 3rd College Edition, 1988.

* cited by examiner

EASILY OPENABLE CAN END, CONTAINER, AND METHODS OF FORMING

CROSS-REFERENCE TO RELATED APPLICATIONS

This application is the National Stage of International Application No. PCT/EP2009/060243 filed Aug. 6, 2009, which claims the benefit of EP application number 08163704.3, filed Sep. 4, 2008, the disclosures of which are incorporated herein by reference in their entirety.

TECHNICAL FIELD

The present invention relates to an easy open can end with an improved means of opening. The invention is particularly suitable for use on metal packaging for food and beverage products.

BACKGROUND ART

Easy-open can ends are well known in the field of can manufacture—for example, that described and shown in FIGS. 4 & 5 of U.S. Pat. No. 5,413,241 (YEH HSI-SHOU) Sep. 5, 1995, and also DE 2540362. The can end is provided with an end panel provided with a score line defining a prearranged opening area. A tab is secured to the end panel, with the nose of the tab located adjacent the score line. To avoid interference between adjacent can ends during transportation of the can ends themselves, the handle of the tab is located against the outer surface of the end panel. It would remain in this position after attachment of the can end to a can body—as is normal practice for virtually all current easy-open can ends. However, this presents a problem for a consumer wishing to open the can because the consumer must first prise the handle of the tab away from the surface of the end panel in order to lift the tab to rupture the score line. The lack of clearance between the tab handle and the end panel makes this an arduous task, especially for those with weak hands.

WO 03/104092 A (MAEIL DAIRY INDUSTRY CO LTD) Dec. 18, 2003 provides one solution to the above problem of tab access. WO 03/104092A discloses a can end having a collapsible protrusion under the handle of the tab. The collapsible protrusion initially protrudes upward from the can end to define a minimal (or zero) gap between the tab and the protrusion (providing efficient stackability of one can end upon another for storage/transportation purposes), but is deformable downwards from the tab to define a concave finger well under the handle of the tab sufficient for a user to insert their finger (providing finger access under the tab and ease of opening by a consumer).

However, there are several problems with the protrusion shown and described in WO 03/104092A:

Firstly, the collapsible protrusion of WO 03/104092A has to occupy a substantial area of the can end in order to define a finger well of sufficient depth to permit a consumer to insert their finger under the tab.

Secondly, when containers incorporating the can end of WO 03/104092A are exposed to positive pressure (i.e. where the pressure within the container is greater than that outside), the protrusion can easily revert into its upward state, thereby removing any clearance under the tab and hindering tab access. Positive pressure may arise due to the environment in which containers incorporating the can end are stored, or due to the nature of the product stored within the container. For example, carbonated beverage products provide continual positive pressure. Alternatively, certain food products may expel gases during their storage. Additionally, the heating from retort processing can result in a build-up of positive pressure within the container.

Thirdly, the protrusion of WO 03/104092A is a non-planar surface, which can present a difficult surface on which to print logos, images or instructions.

There is therefore a need to have an improved can end which:

i. maximises the area of the can end suitable for printing;

ii. is easily stackable for efficient storage/transportation, without risk of the can end becoming trapped between the tab and end panel of an adjacent can end;

iii. is also able to provide and retain tab access to enable a consumer to easily lift the tab (even when subject to positive pressure during use on a container).

DISCLOSURE OF INVENTION

Accordingly, there is provided an easily openable can end comprising an end panel, a score line formed in the end panel to define a prearranged opening area, a tab, the tab having a handle, tab securing means for securing the tab to the end, wherein the end panel is provided with at least one moveable portion contactable with the lower surface of the tab at a location between the tab securing means and the end of the handle of the tab, wherein the moveable portion is deformable upwardly under influence of pressure to push against the lower surface of the tab and thereby incline the handle of the tab away from the end panel to define a gap under the tab to enhance finger access by a user.

The can end of the present invention uses a different mechanism to that of WO 03/104092A to provide finger access under the handle of the tab. The present invention uses deformation of the moveable portion to push the handle of the tab away from the can end without the need for a dedicated finger well under the handle of the tab itself. Consequently, the present invention has a significant advantage over WO 03/104092A in that any positive pressure within a container incorporating the can end would have the effect of enhancing tab access, instead of reducing it.

Another advantage of the present can end is that for a tab of a given length, the present invention requires a moveable portion of a smaller area than for that of WO 03/104092A to provide the same gap under the handle of the tab. This is due to:

the different mechanism by which the present invention provides tab access (i.e. by pushing and reacting against the tab's lower surface); and the location of the moveable portion between the tab securing means and the end of the handle of the tab.

This provides benefits in terms of ease of manufacture because less forming is required. As a general rule, for a moveable portion of a given size, the closer the moveable portion is to the tab securing means, the greater the resulting inclination angle of the tab's handle away from the end panel.

Typically, it is envisaged that the end panel outward of the moveable portion will be generally planar, providing an easier surface on which to print instructions, logos and/or other text/graphics. The reduced area requirement of the moveable portion of the present invention (relative to WO 03/104092A) has the advantage of leaving more room outward of the moveable portion suitable for printing of instructions, logos and/or other graphics/text. This advantage is further enhanced because most of the area of the moveable portion will be hidden under the tab itself.

Ideally, the can end of the present invention would be manufactured with the moveable portion in its initial state (i.e. prior to inclining of the tab). In this state, efficient stacking of one can end upon another is possible without the moveable portion and/or the tab hindering stackability. This maximises the packing density of a stack of can ends during storage and transportation.

Preferably, the moveable portion is in the form of a bistable panel. By a "bistable panel" is meant a panel having two defined stable states.

Conveniently, the moveable portion is formed such that it protrudes downwardly to define a concave well in its initial state and is deformable upwardly under influence of pressure to define a convex protrusion in its upwardly deformed state. Such a concave/convex configuration for the moveable portion is a preferred way of providing the bistable panel described above, with the concave/convex profile providing inherent bistability. To provide improved stackability of one can end upon another when the can ends are in their initial state, it is further preferred that a portion of the tab is inclined inwardly within the concave well. This feature helps in ensuring that any gap between the movable portion and the tab is as small as possible when the can end is in its initial state, thereby maximising the stacking density of the can ends. This inclined portion may be provided by the tab having a curvature generally corresponding to that of the concave well beneath. Alternatively, the inclined portion may be provided by a kink in the tab.

Preferably, the moveable portion is lockable into its upwardly deformed state. This aspect of the present invention provides reassurance against the moveable portion accidentally reverting back into its initial state, which would lead to loss of finger access under the tab. By "lockable" is meant that the force required to cause the moveable panel to deform back into its initial position is greater than that required to first deform it upwardly.

This lockability may be provided by the moveable portion having a plastically deformable region. The application of a predetermined pressure on the underside of the moveable portion would cause this region to plastically deform, such that when the pressure is removed the moveable portion would remain in its upwardly deformed state, thereby retaining the gap under the handle of the tab. By knowing the predetermined pressures that a can end is likely to be subjected to during its use on a container, it is possible to adapt the moveable portion so that plastic deformation is restricted to only the moveable portion of the can end.

A particularly preferred way of providing the plastically deformable region is for the moveable portion to be formed so as to comprise a region of reduced thickness relative to the thickness of the end panel outward of the moveable portion. This region of reduced thickness would increase the susceptibility of the moveable portion to plastically deform. Therefore, if the predetermined pressure were to be applied to the entirety of the underside of the end panel, the reduced thickness of the moveable portion would cause the plastic deformation to be localised to the moveable portion. Various ways in which the "pressure" may be applied to can end are discussed later in this description.

Conveniently, the moveable portion is generally planar in its initial state and is deformable upwardly under influence of pressure to protrude upwardly, all or part of the moveable portion thereby plastically deforming to be lockable into its upwardly deformed state. Preferably, this planar moveable portion is of reduced thickness relative to the thickness of the end panel outward of the moveable portion (as described above).

Although sufficient tab access may be obtained with just a single moveable portion, it has been found beneficial for the can end to comprise two moveable portions, each symmetrically disposed about the longitudinal axis of the tab and contactable with the lower surface of the tab, the moveable portions adapted to simultaneously upwardly deform under influence of pressure to push against the lower surface of the tab and thereby incline the handle of the tab away from the end panel. Using only a single moveable portion can lead to the handle of the tab not being uniformly inclined across the width of the tab. So, the symmetric disposition of the two moveable portions about the longitudinal axis of the tab provides additional assurance that sufficient clearance is provided under the whole width of the tab. Again, the area of the end panel occupied by having two moveable portions would be less than that required for the single collapsing protrusion (i.e. the finger well) of WO 03/104092A.

The can ends of the present invention may be fastened to an access opening of a container body by any conventional process; for example, by double seaming.

As will be noticed, the description refers to the moveable portion being deformable upwardly under influence of "pressure". This pressure may be manually applied prior to fastening of the can end to a container body; for example, by means of a punch acting on the underside of the moveable portion. However, when the can end is used for containers subject (at some point) to positive pressure generated within the container, the positive pressure generated would act to upwardly deform the moveable portion to push against the lower surface of the tab and thereby incline the handle of the tab to provide the tab clearance. Various ways in which the pressure may be generated are described in the following paragraphs:

In the case of carbonated liquid products (for example, fizzy beverage drinks), the positive pressure referred to above would arise naturally from the product itself, with the pressure from the carbonated liquid activating the moveable portion to deform upwardly. Accordingly, in a second aspect of the present invention there is provided a method for providing an easily openable container, comprising the following steps:

a. filling an open-topped container body with either a carbonated liquid product or other product that expels gases during storage;

b. taking a can end as claimed herein and securing the can end to the filled container body to form a sealed container;

c. the product positively pressurising the inside of the container, the moveable portion of the can end deforming upwardly under the action of the positive pressure, to push against the lower surface of the tab and thereby incline the handle of the tab away from the end panel to define a gap under the tab to enhance finger access by a user.

The above method has the advantage that the product itself helps to both provide and retain finger access under the tab, without requiring the moveable portion to plastically deform (or incorporate any special structural feature) to lock itself into its upwardly deformed state. Further, it avoids the need for a separate manufacturing operation to upwardly deform the moveable portion.

In the case of other products (for example, food or non-carbonated liquids), the pressure may be induced by reforming a portion of a sealed, filled container inwardly to reduce the container volume and thereby induce a positive pressure within the container. Accordingly, in a third aspect of the invention, there is provided a method for providing an easily openable container, comprising the following steps:

a. filling an open-topped container body with a product to leave a headspace;

b. taking a can end as claimed herein and securing the can end to the filled container body to form a sealed container;

c. reforming a portion of the container inwardly to reduce the volume of the headspace and thereby positively pressurise the inside of the container, the moveable portion of the can end deforming upwardly under the action of the positive pressure, to push against the lower surface of the tab and thereby incline the handle of the tab away from the end panel to define a gap under the tab to enhance finger access by a user.

The reforming step may be achieved by buckling of the sidewall of the container in a predetermined region. Alternatively (or in addition), the base of the container may be domed inwardly into the container to thereby induce the positive pressure (for example, as disclosed in EP 0521642 A (CMB FOODCAN PLC) Jan. 7, 1993).

In the case of food products that need to be heated for sterilisation purposes, the action of heating the filled container would cause sufficient positive pressure within the container in order to upwardly deform the moveable portion. The heating would occur in a retort. Accordingly, in a fourth aspect of the invention there is provided a method for providing an easily openable container for a food product, comprising the following steps:

a. filling an open-topped container body with a product;

b. taking a can end as claimed in herein and securing the can end to the filled container body to form a sealed container;

c. heating the sealed container;

d. the heating of step 'c' resulting in a build-up of positive pressure within the container, the moveable portion of the can end deforming upwardly under the action of the positive pressure, to push against the lower surface of the tab and thereby incline the handle of the tab away from the end panel to define a gap under the tab to enhance finger access by a user.

Most preferably, during step 'd' the action of the positive pressure plastically deforms the moveable portion such that on cooling of the container to ambient temperature (and the consequent loss/reduction of the positive pressure), the moveable portion remains locked in its upwardly deformed state to thereby retain the gap under the handle of the tab.

In this fourth aspect of the invention, the filled container may or may not include a headspace. Where the filled container does include a headspace, the positive pressure would have two components—that generated by expansion of the headspace gases and that generated by expansion of the product.

BRIEF DESCRIPTION OF FIGURES IN THE DRAWINGS

Embodiments of the present invention are described below, with reference to the following drawings.

Figure 9A:
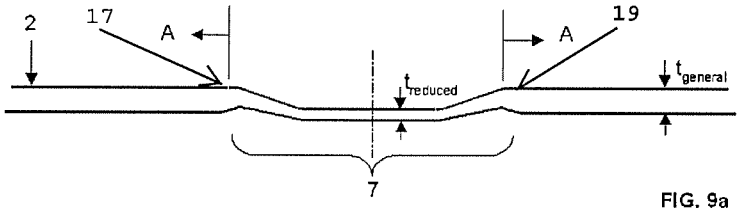
Figure 9B:
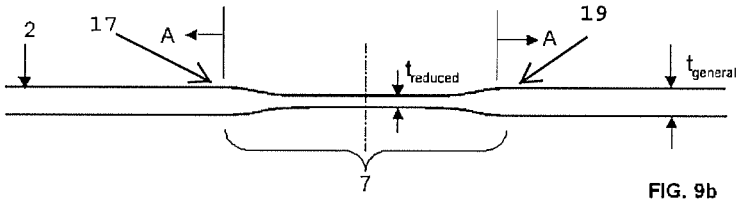

FIGS. 9*a* & 9*b* show two alternative configurations of the moveable portion.

MODE(S) FOR CARRYING OUT THE INVENTION

Figure 7:
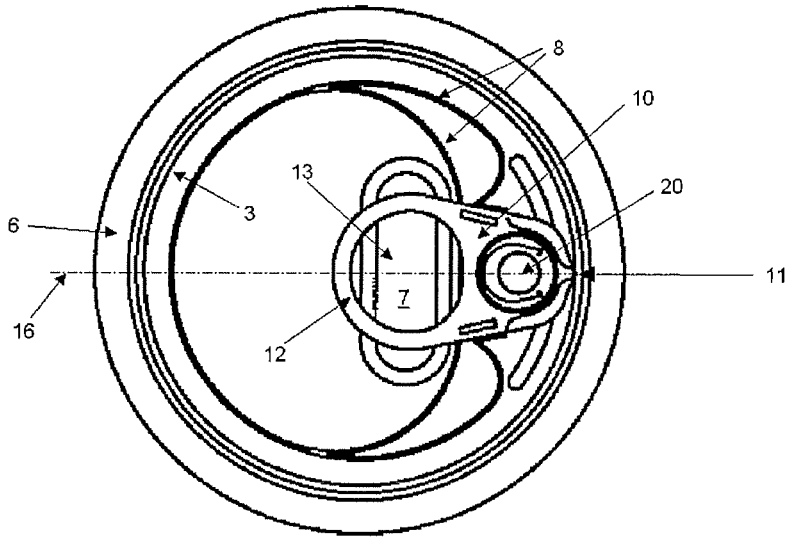
FIG. 7 is a plan view of a can end according to the present invention.
Figure 8:
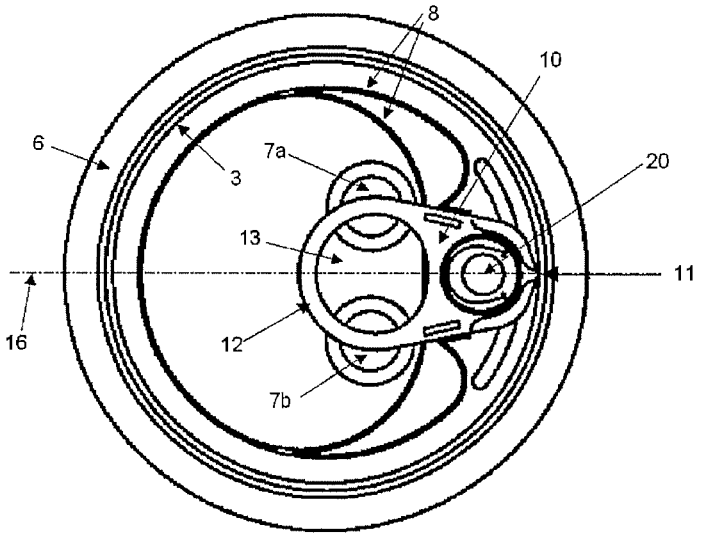
FIG. 8 is a plan view of an alternative can end to that of FIG. 7.

Can end 1 includes an end panel 2 provided with a score line 3. The score line 3 defines a prearranged opening area (an aperture), whereby (in the embodiment illustrated) the whole of the end panel 2 inwards of the score line would be removable from the can end 1. A countersink 4 is located radially outward of the score line 3 (see FIG. 1). A chuck wall 5 extends first upwardly from the bottom of the countersink 4, and then outwardly to define seaming panel 6 (see FIG. 1). Tab 10 is secured to the end panel 2 by means of a rivet 20. One end of the tab 10 is provided with a nose 11 located adjacent the score line 3 (see FIG. 1). The opposite end of the tab 10 has a handle 12 (see FIG. 1). As shown in FIGS. 7 & 8, the handle 12 includes a ring section 13. The can end shown is manufactured from 0.21 mm gauge, double-reduced (DR) tinplate to material specification DR550N. However, other materials providing sufficient strength/rigidity may be used instead.

Figure 1:
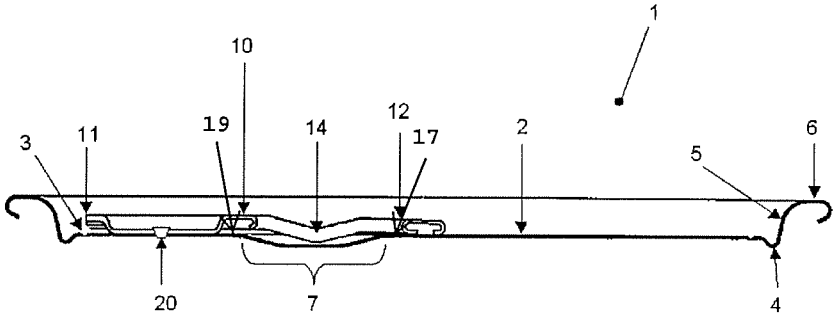
FIG. 1 is a section view through a can end of the present invention in its "as-manufactured" (initial) state before attachment to a container body.

A moveable portion 7 is provided in the end panel 2 in the form of a bistable panel (see FIG. 1). In the embodiments shown, the moveable portion 7 is integral with the end panel 2, thereby reducing the number of discrete structural components making-up the can end 1.

Figure 2:
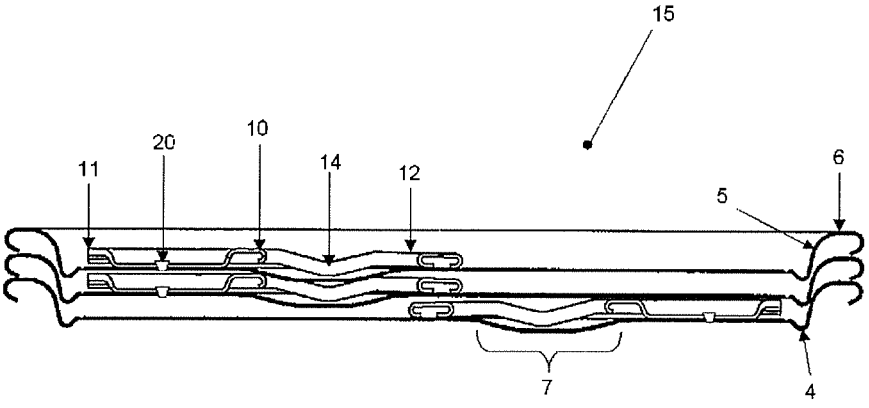
FIG. 2 is a section view through a stack of three can ends.

FIG. 1 shows the bistable panel 7 of the can end 1 in its "as manufactured" or initial state. In this state, the bistable panel 7 defines a concave well that extends below a top surface 17 of a perimeter portion 19 of the end panel 2 under the tab 10. Perimeter portion 19 is disposed about the bistable panel 7. The far end of the handle 12 locates against the outer surface of the end panel 2. Further, the portion of the tab 10 extending over the concave well is inclined inwardly into the concave well by means of a kink 14 in the tab. FIG. 2 shows a stack 15 of can ends 1, and clearly shows how the kinked portion 14 of the tab 10 provides space for accommodating all or part of the concave well of an identical can end stacked above.

The stack 15 of can ends would be transported to the premises of a filler ready for attachment to a container body. Following arrival at the filler's premises, each can end 1 would be fastened to close and seal the access opening of a container body 30 filled with a food product 31 (see FIG. 3). The container body 30 is filled to leave a headspace 32 between the product 31 and the inner surface of the can end 1 (see FIG. 3). A conventional seaming operation is used to fasten the can end 1 to the container body 30 (see the seam 33).

Figure 3:
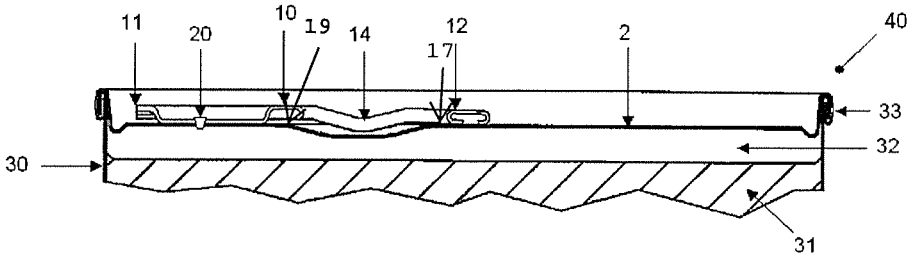
FIG. 3 is a section view through the top portion of a filled, sealed container immediately after attachment of the can end to the container body.
Figure 4:
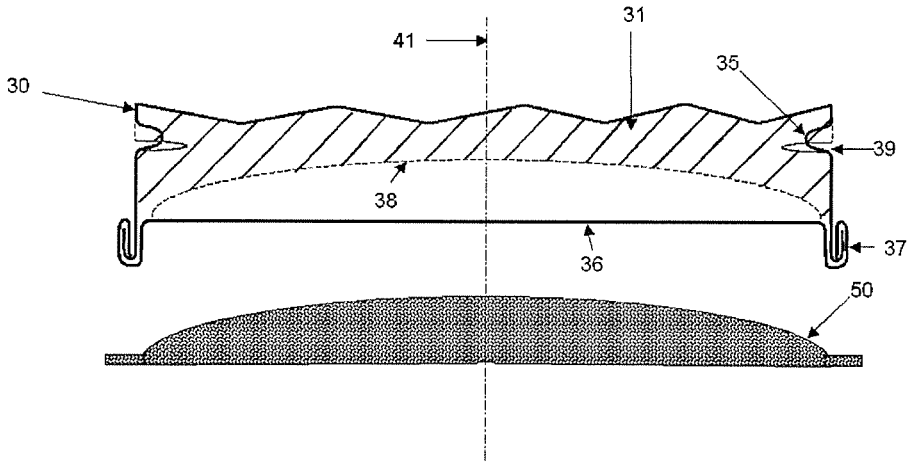
FIG. 4 is a section view through the bottom portion of the container of FIG. 3, showing how a portion of the container is reformed by a punch to induce a positive pressure inside the container.

FIGS. 3 & 4 show separate views of the top portion and bottom portion respectively of the resulting sealed, filled container 40 immediately after seaming-on of the can end 1. As can be seen from FIG. 4, the sidewall of the container body 30 has an annular groove 35, with a conventional planar can end 36 seamed 37 to the bottom of the container body to form the base of the container 40. The "as-manufactured" profile of the bottom portion of the container 40 is shown as a solid black line. The annular groove 35 may be formed, for example, by rolling the sidewall of the container body 30.

Subsequent to seaming-on of the can end 1, a profiled punch 50 is applied to the outer surface of the planar can end 36 on the bottom of the container 40—the punch and/or container being moved progressively towards each other along axis 41. The punch 50 acts to both:

reform the planar can end 36 inwardly to form an inverted domed profile 38; and to cause the annular groove 35 to collapse to form an inwardly projecting bead 39.

The inverted domed profile 38 and the collapsed inwardly projecting bead 39 are shown on FIG. 4 as a thin, dashed line.

Figure 5:
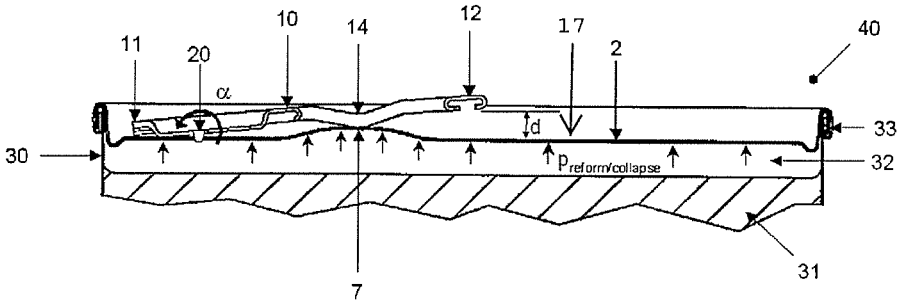
FIG. 5 is a section view through the top portion of the container of FIG. 4 after the reforming operation.

The reforming of the planar can end 36 and collapsing of the annular groove 35 each compress the headspace gases 32, thereby inducing a cumulative positive pressure ($p_{reform/collapse}$) inside the container 40 (see FIG. 5). As shown in FIG. 5, this positive pressure ($p_{reform/collapse}$) is sufficient to cause the bistable panel 7 to deform upwardly into a second state in which it defines a convex protrusion. As the bistable panel 7 upwardly deforms, it reacts and pushes against the lower surface of the tab 10. This pushing action causes the tab 10 to pivot about the rivet 20 by an angle α and define a gap (d) between the handle 12 of the tab and the end panel 2 (see FIG. 5). This gap (d) is sufficient in size to allow a consumer to easily engage their finger(s) under the tab 10. Where the food product 31 does not require any heating or sterilising, the container 40 may then simply be transported for delivery to consumers. The positive pressure ($p_{reform/collapse}$) within the container 40 would resist any reversion of the convex bistable panel 7 back into its initial concave state, thereby ensuring that tab access (d) is maintained.

Figure 6:
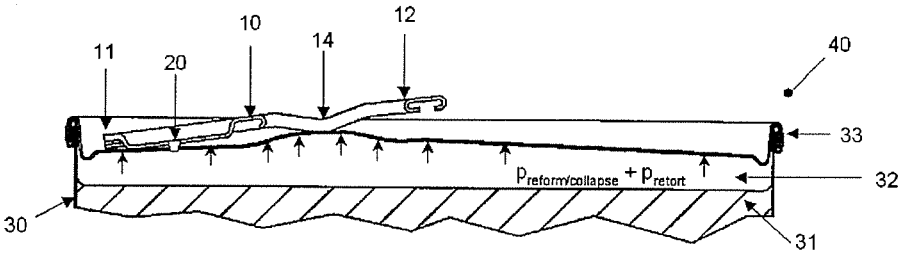
FIG. 6 is a section view through the top portion of the container of FIG. 5 during subsequent retort processing.

Alternatively, the food product 31 may be one requiring cooking/sterilising within a retort. The heat generated by retort processing would cause expansion of the headspace gases 32 and therefore a further increase in pressure ($p_{retort}$) over and above that caused by the base reforming/groove collapse ($p_{reform/collapse}$). As can be seen in FIG. 6, this additional pressure causes the end panel 2 to bow outwards slightly relative to the condition in FIG. 5. However, on cooling to ambient temperature the additional positive pressure from retorting would dissipate and the profile of the can end 1 return to the state occupied immediately after base reforming/groove collapse, i.e. as in FIG. 5. Again, the remaining positive pressure ($p_{reform/collapse}$) within the container 40 would resist any reversion of the convex bistable panel 7 back into its initial concave state, thereby ensuring that tab access (d) is maintained.

In an alternative embodiment (not shown in the figures), the container may instead be filled with a carbonated beverage product or another product that expels gases during its storage. In either case, the nature of the product would generate sufficient positive pressure within the container 40 to cause the moveable portion 7 to deform upwardly from its initial state and thereby incline the tab 10 away from the end panel 2 to provide the tab access (d). The continuous pressure generated by the product itself would avoid having to reform/collapse any part of the container 40 to induce the positive pressure—thereby simplifying manufacture of the container—and also ensure that tab access (d) was maintained during subsequent handling/transportation.

In a further alternative to the embodiments shown and described in FIGS. 1 to 6, the moveable portion 7 incorporates a plastically deformable region. FIGS. 9*a* and 9*b* show two alternative configurations of moveable portion 7 incorporating a plastically deformable region. Both figures show the moveable portion 7 in its "as-manufactured" state—for simplicity, the tab and other features of the can end are not shown. In each configuration, the moveable portion 7 is thinned ($t_{reduced}$) relative to the thickness ($t_{general}$) of the end panel outward of the moveable portion 7 (see arrows A). In the embodiment of FIG. 9*b*, the movable portion 7 would be generally co-planar with the remainder of the end panel 2 in its "as manufactured" state. In the alternative embodiment of FIG. 9*a*, the moveable portion 7 would define a concave well in its "as manufactured" state. Can ends incorporating either form of plastically deformable moveable portion 7 would be readily stackable. When used on containers 40 containing food products requiring cooking/sterilising, the positive pressure induced by the retort process would cause the moveable portion 7 to upwardly deform and react against the tab 10 in a similar manner to the embodiment shown in FIGS. 1 to 6. However, a crucial difference is that this positive pressure would cause plastic deformation of the moveable portion 7. The plastic deformation would lead to the moveable portion 7 remaining in its upwardly deformed state after the container 40 has cooled and the positive pressure from retorting has dissipated. Therefore, it avoids the need to reform part of the container 40 in order to generate and maintain a positive pressure within the container. In effect, the plastically deformable region ensures that the moveable portion 7 may be "locked" into its upwardly deformed state, even when the container is subject to a negative pressure. By "negative pressure" is meant where the pressure inside the container is less than that outside the container.

FIGS. 7 & 8 show plan views of two can ends—each embodiment applicable to the views of FIGS. 1 to 6. In the embodiment of FIG. 7, there is a single moveable portion 7 with a generally oval profile extending under the full width of the centre of the ring-section 13 of the tab 10. In the embodiment of FIG. 8, the can end 1 is provided with two moveable portions 7*a*, 7*b* of a generally circular profile symmetrically disposed about the longitudinal axis 16 of the tab 10. When exposed to positive pressure, each of the moveable portions 7*a*, 7*b* would simultaneously upwardly deform. Both the embodiments of FIGS. 6 & 7 incorporate panelling 8 in the end panel 2 to provide increased rigidity and strength.

The present invention is applicable to can ends regardless of whether the prearranged opening area defined by the score line covers all or only part of the area of the end panel. For example, for applications in which product release is to be maximised, the score line would generally extend to near the periphery of the end panel to maximise the size of the prearranged opening area. Alternatively, for beverage applications, a smaller prearranged opening area is often desired in order to enable a consumer to pour or drink from the container. Dependent on the configuration of can end used, the tab and moveable portion may be located inward or outward of the score line.

The invention claimed is:

1. An easily openable can end comprising:

an end panel that includes a perimeter portion and at least one moveable portion disposed within the perimeter portion, a score line formed in the end panel defining an opening area, a tab secured to the end panel by a rivet, the tab having a handle, wherein the at least one moveable portion is moveable between (i) a first position, whereby the at least one moveable portion is spaced away from a lower surface of the tab so as to define a concave well that extends below a top surface of the perimeter portion and, (ii) a second position, whereby the at least one moveable portion contacts the lower surface of the tab to thereby incline the handle of the tab away from the end panel to define a gap under the tab.

2. A can end as claimed in claim 1, wherein the at least one moveable portion is a bistable panel.

3. A can end as claimed in claim 1, wherein, in its second position, the at least one movable portion is deformed upwardly under influence of pressure to define a convex protrusion.

4. A can end as claimed in claim 3, wherein a portion of the tab extends over the concave well, the portion inclined inwardly within the concave well to thereby facilitate efficient stacking of the can end upon another can end.

5. A can end as claimed in claim 1, wherein a force required to cause the at least one moveable portion to deform from its second position to its first position is greater than that required to deform the at least one moveable portion from its first position to its second position.

6. A can end as claimed in claim 5, wherein the at least one moveable portion includes a plastically deformable region.

7. A can end as claimed in claim 6, wherein the plastically deformable region includes a region of reduced thickness relative to the thickness of the end panel outward of the at least one moveable portion.

8. A can end as claimed in claim 6, wherein the at least one moveable portion is generally planar in its first position and is deformable to its second position under influence of pressure to protrude upwardly, all or part of the at least one moveable portion thereby plastically deforming into its second position.

9. A can end as claimed in claim 1, wherein the at least one moveable portion comprises two moveable portions, each symmetrically disposed about the longitudinal axis of the tab and contactable with the lower surface of the tab, the two moveable portions adapted to simultaneously upwardly deform under influence of pressure to push against the lower surface of the tab and thereby incline the handle of the tab away from the end panel.

10. A can end as claimed in claim 1, wherein the gap under the tab enhances finger access of a user.

11. A container comprising:

a container body; and a can end seamed to the container body, the can end including:

an end panel having a perimeter portion and at least one moveable portion disposed within the perimeter portion, a score line formed in the end panel defining an opening area, a tab secured to the end panel by a rivet, the tab having a handle, wherein the at least one moveable portion is moveable between (i) a first position, whereby the at least one moveable portion is spaced away from a lower surface of the tab so as to define a concave well that extends below a top surface of the perimeter portion and, (ii) a second position, whereby the at least one moveable portion contacts the lower surface of the tab to thereby incline the handle of the tab away from the end panel to define a gap under the tab.

12. A container as claimed in claim 11, wherein the gap under the tab enhances finger access of a user.

13. A method for assembling an easily openable container, comprising the following steps:

a. filling an open-topped container body with either a carbonated liquid product or other product that expels gases during storage;

b. positioning a can end including an end panel, a score line defining an opening area, a tab secured to the end panel by a rivet, the tab having a handle, the end panel including a perimeter portion and at least one moveable portion disposed within the perimeter portion, the at least one moveable portion being moveable between a first position and a second position, when in the first position the at least one moveable portion is spaced away from a lower surface of the tab to define a concave well that extends below a top surface of the perimeter portion; and c. securing the can end to the filled container body to form a sealed container;

wherein the product positively pressurizes the inside of the container such that the moveable portion of the can end deforms upwardly under pressure to the second position in which the moveable portion pushes against the lower surface of the tab and thereby inclines the handle of the tab away from the end panel so as to define a gap under the tab.

14. A method as claimed in claim 13, wherein the gap under the tab enhances finger access of a user.

15. A method for assembling an easily openable container, comprising the following steps:

a. filling an open-topped container body with a product to leave a headspace;

b. positioning a can end including an end panel, a score line defining an opening area, a tab secured to the end panel by a rivet, the tab having a handle, and the end panel including a movable portion in a first position spaced away from a lower surface of the tab;

c. securing the can end to the filled container body to form a sealed container; and d. reforming a portion of the sealed container inwardly to reduce the volume of the headspace and thereby positively pressurize the inside of the container such that the movable portion of the end panel deforms upwardly under positive pressure inside the container from the first position to a raised, second position in which the movable portion of the end panel pushes against a lower surface of the tab and thereby inclines the handle of the tab away from the end panel to define a gap under the tab.

16. A method as claimed in claim 15, wherein the gap under the tab enhances finger access of a user.

17. A method for assembling an easily openable container for a food product, comprising the following steps:

a. filling an open-topped container body with a food product;

b. positioning a can end including an end panel, a score line defining an opening area, a tab secured to the end panel by a rivet, the tab having a handle, the end panel including at least one moveable portion in a first position spaced away from a lower surface of the tab;

c. securing the can end to the filled container body to form a sealed container; and d. heating the sealed container; wherein the heating step results in a build-up of positive pressure within the container such that the moveable portion of the end panel deforms upwardly under positive pressure inside the container from the first position to a raised, second position in which the moveable portion of the end panel pushes against a lower surface of the tab and thereby inclines the handle of the tab away from the end panel to define a gap under the tab.

18. A method as claimed in claim 17, wherein the action of the positive pressure plastically deforms the moveable portion such that on cooling of the container to ambient temperature the moveable portion remains in its upwardly deformed state to thereby retain the gap under the handle the tab.

19. A can end as claimed in claim 17, wherein the gap under the tab enhances finger access of a user.

* * * * *